US006393743B1

(12) United States Patent
Whitworth

(10) Patent No.: US 6,393,743 B1
(45) Date of Patent: May 28, 2002

(54) VARIABLE DECORATIVE DISPLAY

(76) Inventor: Douglas Andrew Whitworth, The Woodlands Brundish, Woodbridge, Suffolk, IP13 8BH (GB)

( * ) Notice: Subject to any disclaimer, the term of this patent is extended or adjusted under 35 U.S.C. 154(b) by 0 days.

(21) Appl. No.: 09/424,681

(22) PCT Filed: May 28, 1998

(86) PCT No.: PCT/GB98/01384

§ 371 (c)(1),
(2), (4) Date: Nov. 29, 1999

(87) PCT Pub. No.: WO98/54000

PCT Pub. Date: Dec. 3, 1998

(30) Foreign Application Priority Data

May 28, 1997 (GB) ..... 9710836

(51) Int. Cl.[7] ..... B42D 15/00

(52) U.S. Cl. ..... 40/124.01; 40/124.09; 283/50; 283/81

(58) Field of Search ..... 40/124.01, 124.09, 40/124.11, 124.13, 514, 515, 538, 539; 283/58, 81, 105

(56) References Cited

U.S. PATENT DOCUMENTS

| | | | | | |
|---|---|---|---|---|---|
| 1,199,761 | A | * | 10/1916 | Chase | 283/40 |
| 2,824,394 | A | | 2/1958 | Lohnes | |
| 4,012,857 | A | * | 3/1977 | Leskovec | |
| 4,583,763 | A | * | 4/1986 | Shacklett | 283/5 |
| 5,308,119 | A | * | 5/1994 | Roshkoff | 283/58 |
| 5,489,123 | A | * | 2/1996 | Roshkoff | 283/58 |

FOREIGN PATENT DOCUMENTS

| | | |
|---|---|---|
| BE | 537372 | 2/1958 |
| WO | WO89/00877 | 2/1989 |

* cited by examiner

*Primary Examiner*—Chuck Y. Mah
*Assistant Examiner*—Enoch Peavey
(74) *Attorney, Agent, or Firm*—Clyde L. Smith; Kenneth Solomon; Thompson CoburnLLP

(57) ABSTRACT

A greetings card (10) has a fold-out insert in the form of a strip (16) which carries, for example, a repeating pattern of birthday candles. The strip is cut (e.g. at 16) by the giver of the card so that the number of birthday candles remaining corresponds to the age of the recipient. The insert may be sold separately from the card, and may be attached to a card selected separately by the giver of the card. The strip may be attached (either by the user or by the manufacturer) to objects other than a card.

47 Claims, 5 Drawing Sheets

VARIABLE DECORATIVE DISPLAY

This invention relates to a decorative display which can be customised by the user, to a particular display size. The device is intended to be customised by the purchaser in accordance with requirements, to display a particular desired result.

The invention is particularly suitable for use in greetings cards, or as a greetings card. The purchaser of a greetings card in accordance with this invention can customise the card to suit the circumstances in which the card is being given. The invention is not however restricted to this application, and can be used in other circumstances where items are purchased to provide a decorative display, and where there is a desire to customise the item before it is displayed.

According to the invention, there is provided a device for displaying decorative material to a variable extent as determined by a user, the device comprising an elongate strip which is divided into sections and is adapted to be divided by the user at any one of the section divisions to shorten the part of the strip which will be displayed to a desired length.

The device can be an insert for a greetings card, a greetings card on its own, or a decorative display of some other form. The strip can either be mounted on a support or can exist alone as a decorative display. The strip can be folded or rolled for storage prior to display.

The device may be sold to individual purchasers as an insert, and the purchaser can buy separately a greetings card into which the (cut-to-length) insert can be inserted and fixed in place.

According to a particular form of the invention, there is provided a greetings card having an insert in the form of a folded elongate strip which can be folded out from the card, the strip being attached to the card at one end and being divided into sections, the strip being adapted to be divided at any of the section divisions to shorten the part of the strip attached to the card to a desired length.

The strip can have multiple images, with boundaries between the images serving as section divisions.

Such a card is particularly appropriate as a birthday card, where the length of the insert can be shortened by the purchaser of the card to a length commensurate with the birthday of the person to whom the card is being given. For example, the strip may carry a repeating pattern of birthday candles, and the user can shorten the strip to the number of candles equivalent to the number of the birthday of the person to whom the card is to be given. In this case, the insert can be divided into sections by the spaces between individual candles, and can be cut with a pair of scissors at the appropriate section division. It may alternatively to be possible to provide perforations at the section divisions so that the insert can be shortened by tearing across a set of perforations. The invention is not however restricted to the use of birthday candles as section divisions.

Most greetings cards consist of at least two folded leaves and in a simple card construction which has two folded leaves, the insert can be provided between the two leaves, with one end of the insert being attached close to the fold line which joins the two leaves. However the invention is not restricted to the cards having only one fold, and can be used in cards having more than one fold or indeed in cards having no fold, i.e., consisting of only one leaf (the insert can then be attached on one side or the other of the leaf).

The insert can be attached within the card adjacent an edge of the card on which the card will stand on a surface. Then, when the insert is folded out, the insert can also stand on the same surface to display the pattern on the insert.

Alternatively, the insert can fold out in a direction which is not parallel to the surface on which the card will stand. For example, the insert can fold out from the top or from the bottom of the card.

The same insert can be used in a variety of cards carrying different messages or pictures on the outside, and the invention therefore also provides an insert for a greetings card, the insert being in the form of a folded elongate strip, one end of which is to be attached to the card, the strip being divided into sections and being adapted to be divided at any one of the section divisions to shorten the strip to a desired length.

The sections can be defined, as suggested above, by individual pictures of birthday candles printed on an elongate strip, or by a variety of other appropriate indexing methods which count birthdays, anniversaries, exam results or any other numerically quantifiable events.

The strip is preferably of paper and may be printed on one or both sides. If it is printed on only one side, the reverse can be used by the purchaser for writing messages or greetings. The section divisions will normally be identified by the printed pattern on the sheet, but may also be defined by perforations as mentioned earlier.

The strip may alternatively be of thin card, or of a plastics film.

The strip may be parallel sided, or may be of varying transverse dimension. One or both edges may be die-cut to provide a regular or irregular pattern along one or both edges of the strip. The section divisions may be defined by the die-cut pattern.

If a transparent plastics film is used, the film can be parallel sided, with part of the film printed and part unprinted, to give the visual effect of a die cut edge.

When an edge is die-cut, it is preferably cut without any undercut or indented edges, so that superimposed lengths of the folded strip do not get caught up on one another.

The invention will now be further described, by way of example, with reference to the accompanying drawings in which.

Figure 1:
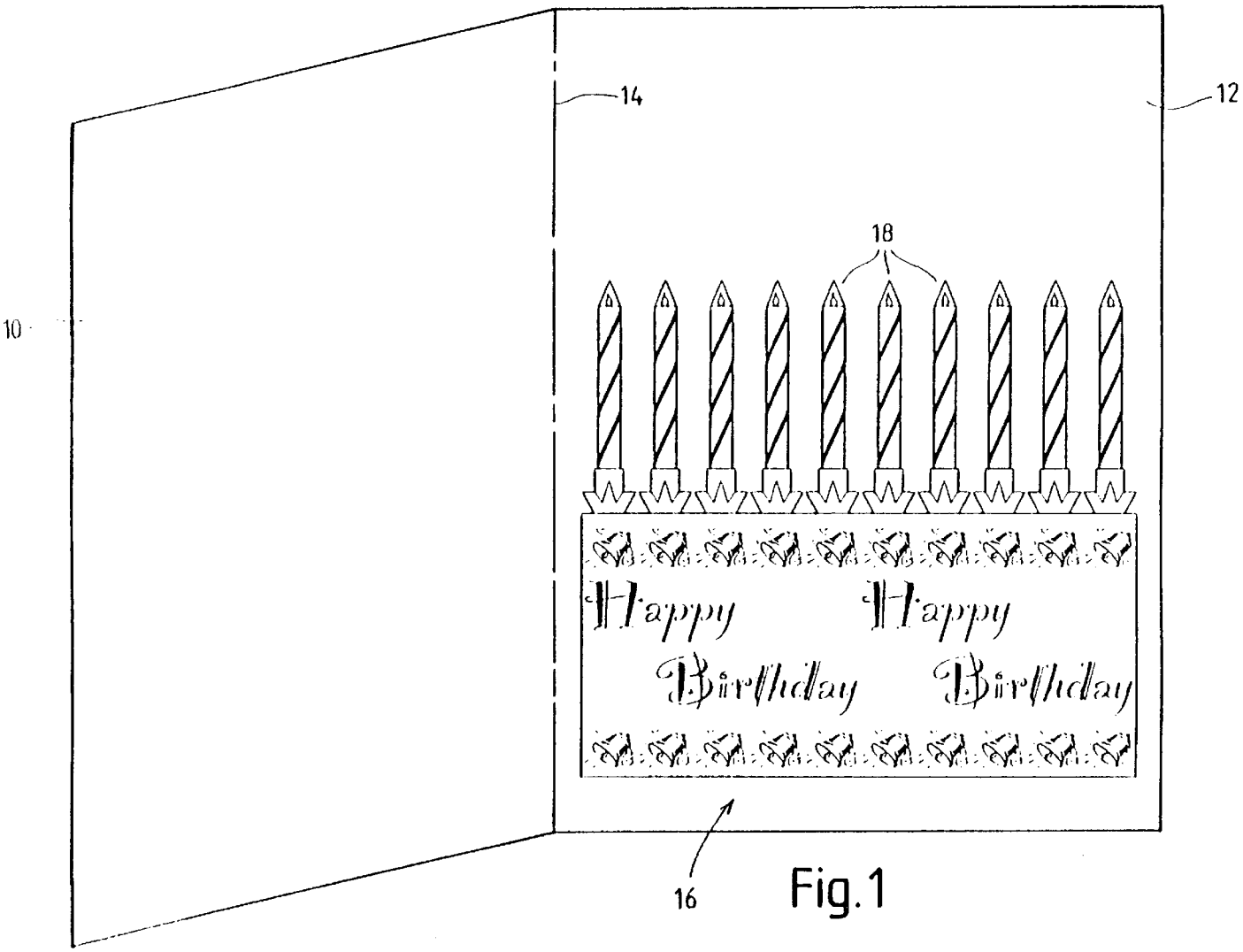
FIG. 1 shows a birthday card opened out to reveal an insert.

FIG. 1 shows the interior of a simple, single-fold greetings card with a front leaf 10 and a rear leaf 12 joined at a fold line 14. Normally a picture or message would be printed on the outside of the front leaf 10, but this cannot be seen in FIG. 1 and forms no part of the present invention.

Figure 2:
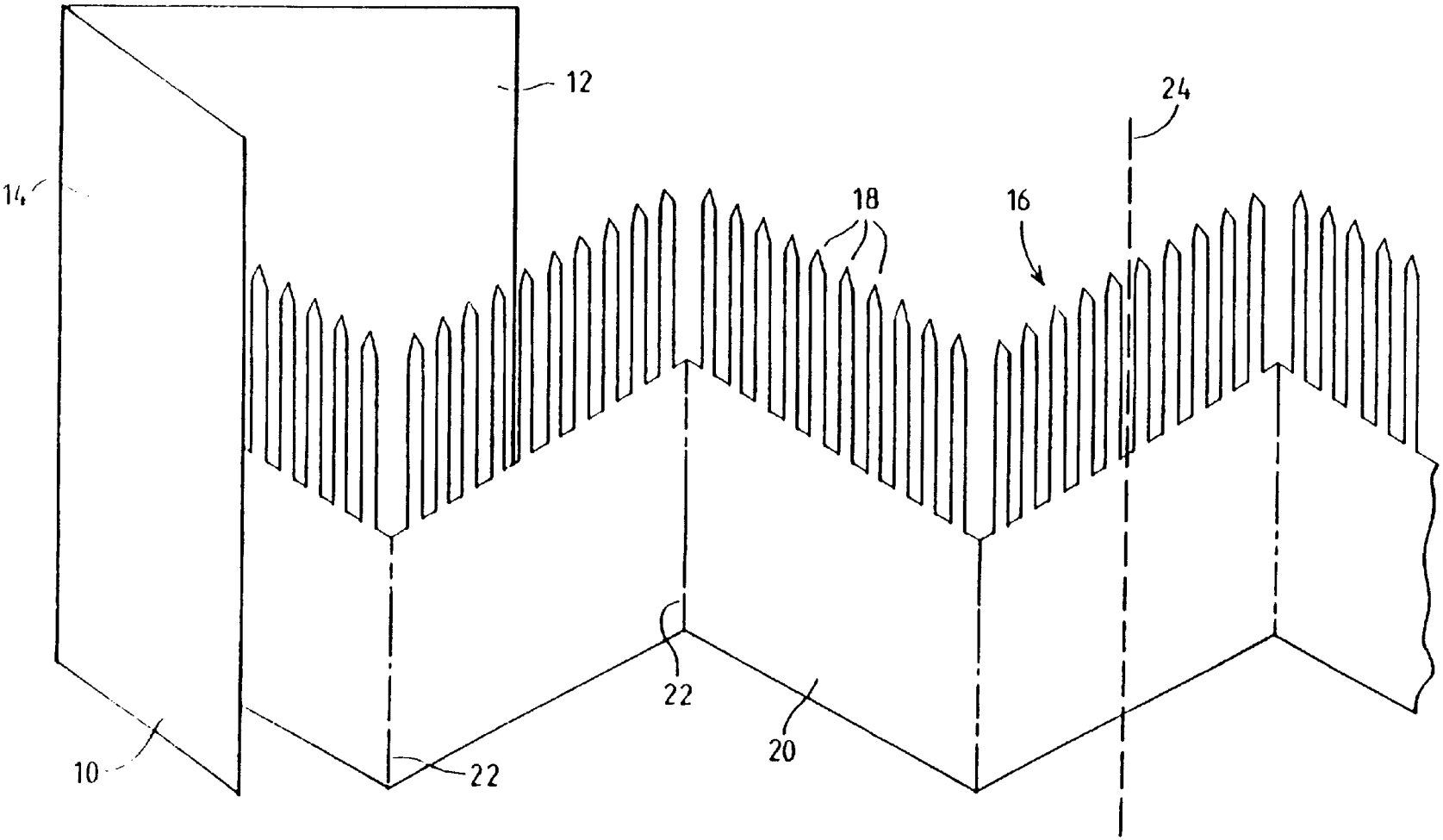
FIG. 2 shows the card of FIG. 1 with the insert unfolded.

Inside the card, and mounted on the rear leaf 12 is an insert 16. This insert is, in this case, printed with the message "Happy Birthday" and is intended to resemble a birthday cake with candles 18 along the top edge. The insert 16 in fact consists of a fan- or concertina-folded elongate strip 20, one end of which is stuck to the rear leaf 12 and the rest of which can be unfolded as shown in FIG. 2. It will be seen from FIG. 2 that the candles 18 which are along the top edge of the strip 20 are die-cut so that they extend individually upwards from the edge of the strip. The length of the strip will vary depending upon the nature of the card, and the considerations discussed below. In FIG. 2, the strip is shown in part only; it can be longer than shown in FIG. 2.

Fold lines where the strip will be fan-folded are indicated at 22 in FIG. 2. The folds 22 will be equally spaced along the length of the strip so that when the strip is folded, as shown in FIG. 1, the individual folds lie directly one on top of another, and the die-cut candles 18 lie directly one on top of another.

For example, if the purchaser of the card is buying the card for somebody's 45th birthday, then the giver of the card will count, starting from the edge of the strip fixed to the card, 45 candles, and will then cut the strip, for example at a position as indicated at 24, so that the person receiving the card will receive a card with an insert having 45 candles, one for each year. The part of the strip 16 which has been cut off (ie to the right of the line 24) will be discarded. To make life easier, the strip may have a small row of numbers printed along its bottom edge, to show the giver where to cut.

Figure 3:
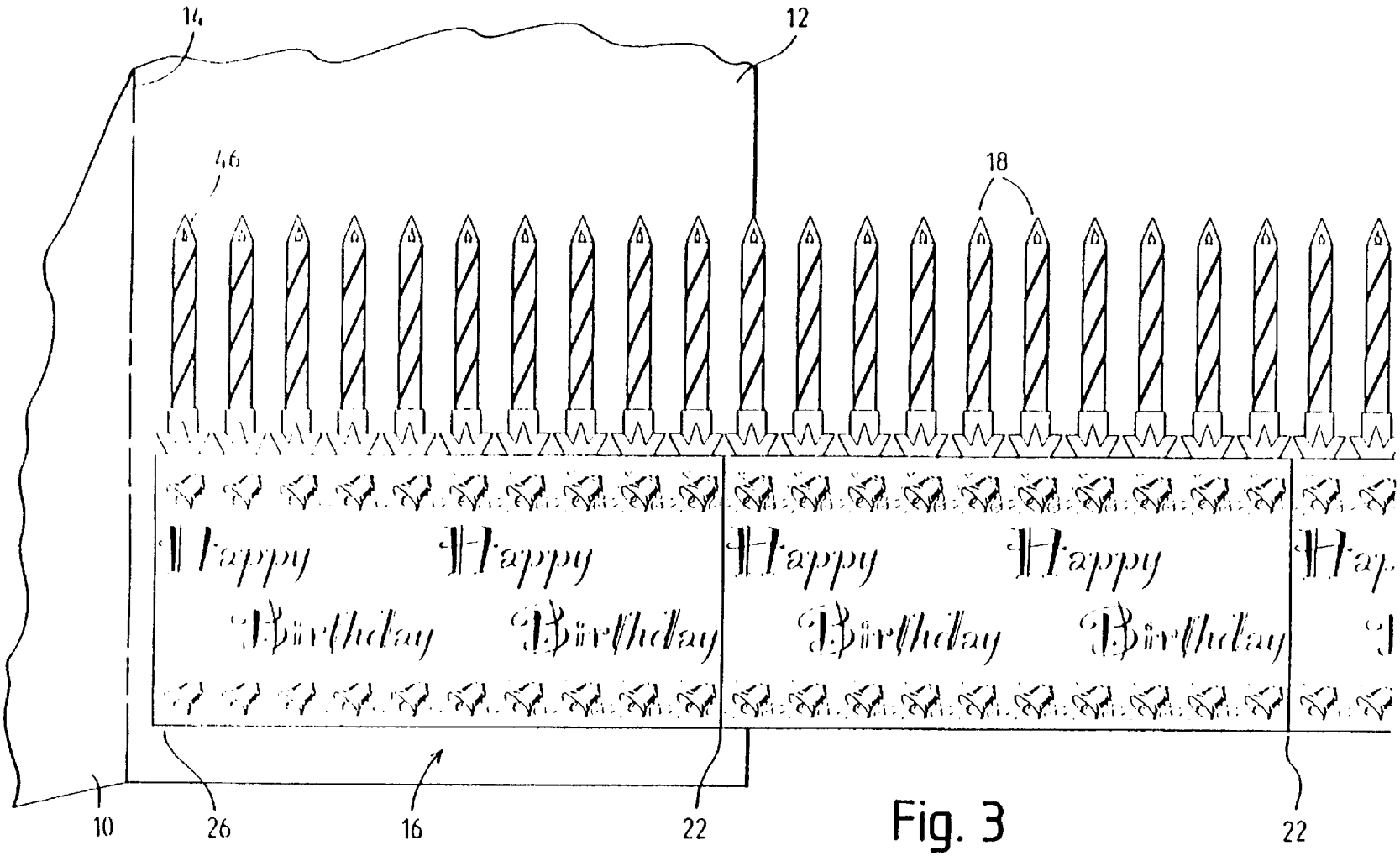
FIG. 3 is a more detailed view of the form of the insert.

FIG. 3 shows the insert 16 folded out and laid flat. Here the individual candles can be clearly seen, and the insert will be stuck to the rear leaf 12 of the card at 26.

In the example shown, the person cutting the insert will simply select a position between two of the candles, and cut the insert with a pair of scissors. It is however possible that the design of the insert could include printed dotted lines to indicate to the user where the insert can be cut to separate sections, or the insert can be provided with lines of perforations along which sections can be separated.

Figure 4:
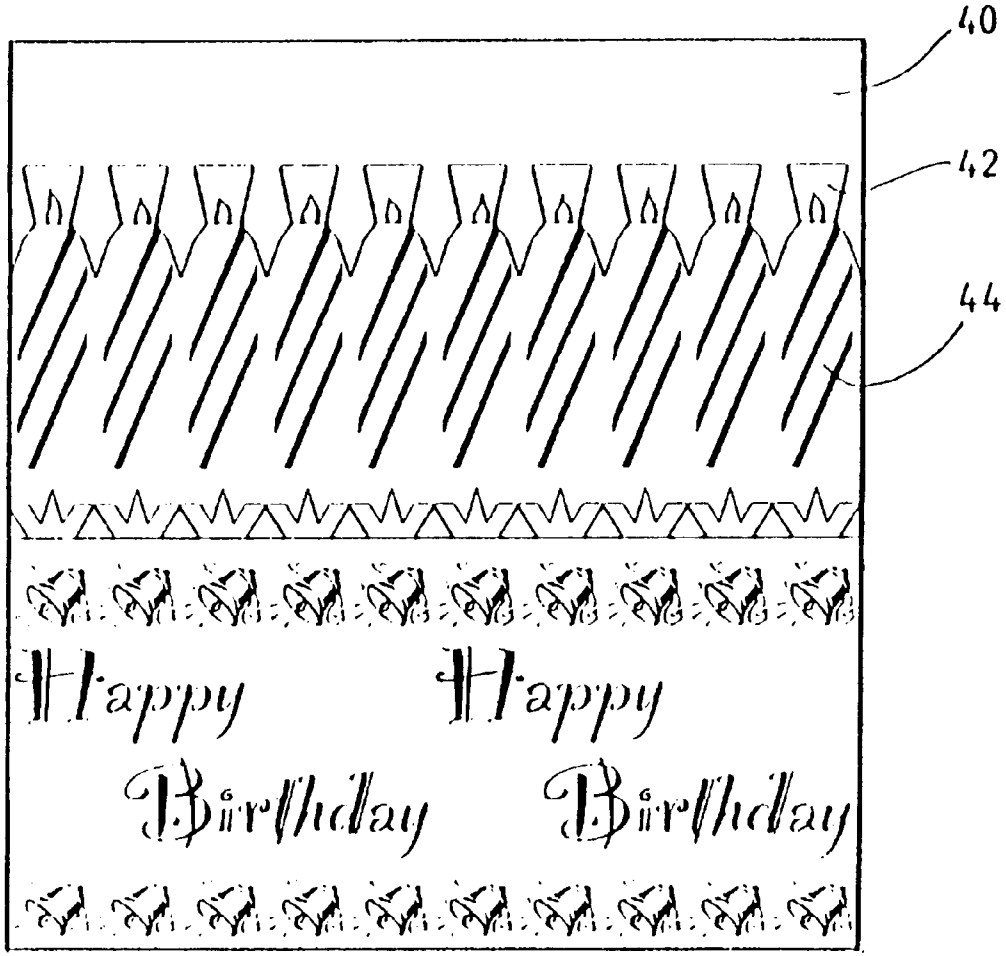
FIG. 4 shows the artwork from which the insert is formed, before die-cutting.

FIG. 4 shows a short piece of the printed insert, before die-cutting of the candles. The portion 40 shown in FIG. 4 is a continuous sheet, and the candle flames 42 are printed oversize, as are the stems of the candles at 44. Because of the oversize printing of the candle stems and flames, when die-cutting takes place, what remains after the die-cutting will always be part of the printed area and there will be no white space, even if the die-cutting should be slightly out of register with the printing.

In order to ensure that the candles on one-fold do not become entangled with the candles on an adjacent fold, the candles and their flames are cut with straight sides and a conical tip, as can be seen most clearly in the left most candle 46 on FIG. 3, to avoid undercuts, reentrant portions or the like which might cause layers of the folded strip to get entangled with one another.

Figure 5:
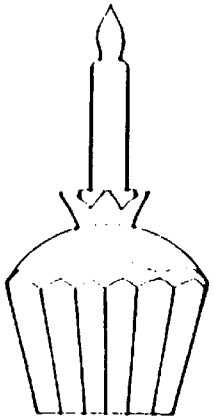
FIG. 5 shows an individual element of an alternative form of free-standing frieze or insert.
Figure 6:
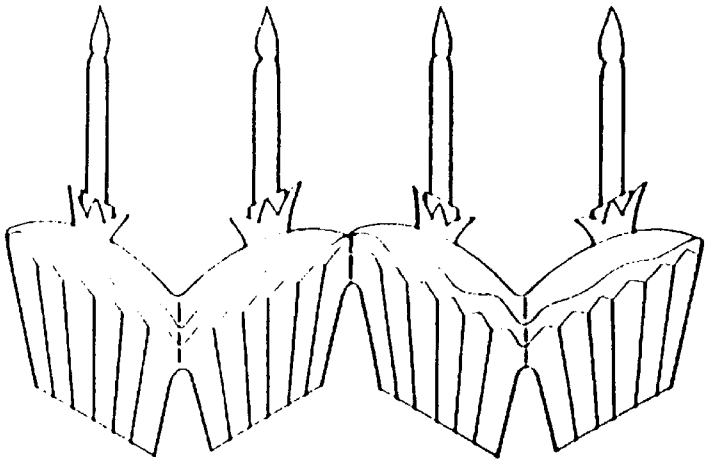
FIG. 6 shows a card made up from individual elements of the form shown in FIG. 5.

The arrangement of the insert shown in FIGS. 1 to 3 can typically hold up to one hundred candles and therefore can be bought for the birthday celebrations of all but centagenarians. However in some cases it may be desirable to sell cards specifically for children, where the insert need be divided only into, say, twenty-one sections. An example of this is shown in FIGS. 5 and 6, where each section is in the form of a fairy cake with a single candle on top, and each fold of the insert holds only one of these candles. An insert of this type with twenty-one folds and twenty-one candles can be customised for a birthday of anything up to twenty-one years. It will be noted that, in this embodiment, the divisions between the sections coincide with the fold lines of the insert and this can simplify the dividing of the card at the appropriate point. The folds may weaken the insert so that the sections can be separated simply by tearing.

Figure 7:
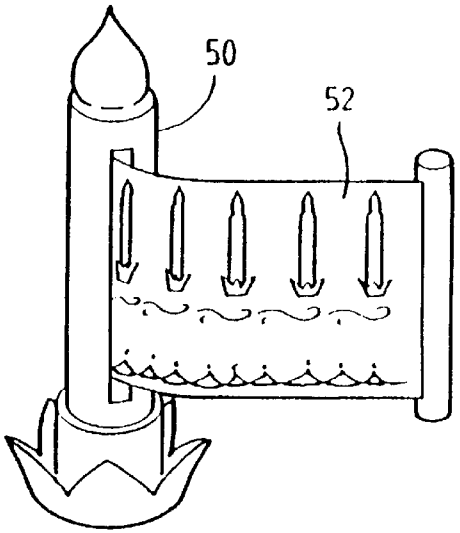
FIG. 7 shows a display device for displaying decorative material.

The principle underlying the invention can be used in applications other than greetings cards. FIG. 7 shows a storage body 50 in the form of a candle with a hollow interior. An insert in the form of a strip 52 is wound in a roll in the interior of the candle and can be pulled out to any desired length and can be cut off where desired in accordance with the occasion. Instead of a candle 50, the insert 52 could be housed in any appropriate body shape.

Figure 8:
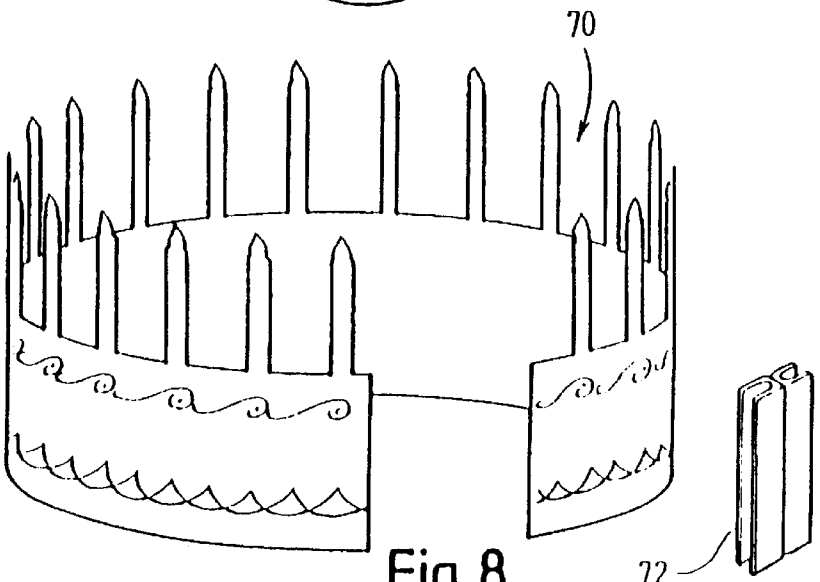
FIG. 8 shows another embodiment of the invention.

Finally, FIG. 8 shows a frieze of candles which can be stored in a rolled up form. The purchaser can cut the frieze to length, and the recipient can make up the cut-to-length frieze into a circle, with the ends being clipped together with a clip 72 into which the ends of the frieze can be inserted. The result emulates a birthday cake, with the correct number of candles for the recipient's age.

Any suitable printing technique can be used to prepare the insert, and to enhance the appearance of the insert, parts can be provided with added glitter or colours. It might even be possible to make the flames at the tips of the candles of the FIGS. 1–3 embodiment by applying holograms to the insert, so that the flames appear to sparkle and change shape. Clearly any known printing or decorative material on substrates can be applied to this invention.

The result is a an unusual card, which the purchaser can customise to the person to whom the card will be given.

What is claimed is:

1. A numerical value display device for displaying decorative material to a variable extent as determined by a user, the device comprising: an elongated strip having a plurality of section divisions that divide the strip into a plurality of sections, each of the sections having at least one symbol, the symbols of the sections being indicative of an increasing numerical sequence, the strip being adapted to be divided by the user at any one of the section divisions to shorten the strip into a portion of the strip which can be displayed such that the symbols of the sections of the portion of the strip are indicative of a desired numeral of the numerical sequence when the strip is so divided.

2. The device of claim 1 in the form of a greetings card.

3. The device of claim 1, having means at one end of the strip for securing said end of the strip as an insert in a greetings card.

4. The device of claim 1, wherein the strip is folded in a concertina-fashion providing the strip with a plurality of folds.

5. The device of claim 1, wherein the strip is rolled.

6. The device of claim 1, wherein the strip has multiple images, with boundaries between the images serving as the section divisions.

7. The device of claim 6, wherein the multiple images are repeating, identical images.

8. The device of claim 1, wherein the sections are numbered.

9. The device of claim 4, wherein a plurality of the sections exist on each of the folds.

10. A greetings card comprising: a card and an insert in the form of a folded elongated strip which can be folded out from the card, the strip having a plurality of section divisions that divide the strip into a plurality of sections and an end that is attached to the card, each of the sections having at least one symbol, the symbols of the sections being indicative of an increasing numerical sequence, the strip being adapted to be divided at any of the section divisions to shorten the strip into a portion of the strip that remainsattached to the card such that the symbols of the sections of the portion are indicative of a desired numeral of the numerical sequence when the strip is so divided.

11. The greetings card of claim 10, wherein the sections each have only one of the symbols and each of the symbols depicts a single candle.

12. The greetings card of claim 10, wherein the strip is of card, and the sections can be separated using a pair of scissors.

13. The greetings card of claim 10, wherein a line of perforations is provided at each of the section divisions so that the insert can be shortened by tearing across one of the lines of perforations.

14. The greetings card of claim 10, wherein the card has two leaves that are joined about a fold line, the insert is provided between the two leaves with the end of the insert being attached to one of the two leavesclose to the fold line.

15. The greetings card of claim 10, wherein the insert is attached within the card adjacent an edge of the card on which the card will stand on a surface.

16. The greetings card of claim 10, wherein the insert is adapted to fold out in a direction which is not parallel to a surface on which the card will stand.

17. The greetings card of claim 10, wherein the strip is of paper.

18. The greetings card of claim 10, wherein the strip has opposite sides and is printed on one of the sides.

19. The greetings card of claim 10, wherein the strip has opposite sides and is printed on both of the sides.

20. The greetings card of claim 10, wherein the section divisions are identified by a printed pattern on the strip.

21. The greetings card of claim 19, wherein the section divisions are defined by perforations.

22. The greetings card of claim 10, wherein the section divisions are identified by numbers printed on the strip.

23. The greetings card of claim 10, wherein the strip is of thin card.

24. The greetings card of claim 10, wherein the strip is of a plastic film.

25. The greetings card of claim 10, wherein the strip has opposite parallel edges.

26. The greetings card of claim 10, wherein the strip has opposite edges and at least one of the edges of the strip has been cut in a nonlinear pattern.

27. The greetings card of claim 26, wherein the section divisions are defined by the pattern.

28. The greetings card of claim 24, wherein the plastic film has a transparency, the strip has opposite parallel, linear edges and the strip has printing that, together with the transparency of the plastic film, provides a visual effect of at least one of the edges being nonlinear.

29. The greetings card of claim 26, wherein the at least one of the edges of the strip is cut without any re-entrant, undercut or indented edges, so that superimposed lengths of the folded strip do not get caught up on one another.

30. An insert for a greetings card, the insert being in the form of a folded elongated strip, one end of which is to be attached to the card, the strip having a plurality of section divisions that divide the strip into a plurality of sections, each of the sections having at least one symbol, the symbols of the sections being indicative of an increasing numerical sequence, the strip being adapted to be divided at any one of the section divisions to shorten the strip such that the symbols of the sections of the strip are indicative of a desired numeral of the numerical sequence when the strip is so divided.

31. The insert of claim 30, wherein the sections each have only one of the symbols and each of the symbols depicts a single candle.

32. The insert of claim 30, wherein the strip is of card, and the sections can be separated using a pair of scissors.

33. The insert of claim 30, wherein a line of perforations is provided at each of the section divisions so that the insert can be shortened by tearing across one of the line of perforations.

34. The insert of claim 30, wherein the strip is of paper for a greeting card substantially as herein described with reference to any one embodiment shown in the accompanying drawings.

35. The insert of claim 30, wherein the strip has opposite sides and is printed on one of the sides.

36. The insert of claim 30, wherein the strip has opposite sides and is printed on both of the sides.

37. The insert of claim 30, wherein the section divisions are identified by a printed pattern on the strip.

38. The insert of claim 31, wherein the section divisions are defined by perforations.

39. The insert of claim 30, wherein the section divisions are identified by numbers printed on the strip.

40. The insert of claim 30 wherein the strip is of thin card.

41. The insert of claim 30, wherein the strip is of a plastic film.

42. The insert of claim 30, wherein the strip has opposite parallel edges.

43. The insert of claim 30, wherein the strip has opposite edges and at least one of the edges of the strip has been cut in a nonlinear pattern.

44. The insert of claim 43, wherein the section divisions are defined by the pattern.

45. The insert of claim 41, wherein the plastic film has a transparency, the strip has opposite parallel, linear edges and the strip has printing that, together with the transparency of the plastic film, provides a visual effect of at least one of the edges being nonlinear.

46. The insert of claim 43, wherein the at least one of the edges of the strip is cut without any re-entrant, undercut or indented edges, so that superimposed lengths of the folded strip do not get caught up on one another.

47. The insert of claim 30, having means at the end of the strip for securing the end of the strip to a greetings card.

* * * * *